United States Patent [19]

Mandy

[11] 4,068,981

[45] Jan. 17, 1978

[54] BLADE-TYPE ROTARY COMPRESSOR WITH FULL UNLOADING AND OIL SEALED INTERFACES

[75] Inventor: Zoltan A. Mandy, Waynesboro, Pa.

[73] Assignee: Frick Company, Waynesboro, Pa.

[21] Appl. No.: 704,886

[22] Filed: July 13, 1976

[51] Int. Cl.[2] ..... F04B 49/02; F01C 21/04; F04C 27/00; F04C 29/02

[52] U.S. Cl. ..... 417/310; 417/440; 418/76; 418/99

[58] Field of Search ..... 417/310, 440; 418/76, 418/99, 82, 97, 98

[56] References Cited

U.S. PATENT DOCUMENTS

| | | | |
|---|---|---|---|
| 845,114 | 2/1907 | Palmer | 418/76 |
| 1,973,063 | 9/1934 | Grier | 418/76 |
| 2,069,767 | 2/1937 | McCormack | 417/310 |
| 2,275,774 | 3/1942 | Kraissl | 418/76 |
| 3,295,752 | 1/1967 | Bellmer | 417/310 |
| 3,399,826 | 9/1968 | Andriulis | 418/212 |
| 3,989,413 | 11/1976 | McGahan et al. | 417/310 |

FOREIGN PATENT DOCUMENTS

| | | | |
|---|---|---|---|
| 1,303,685 | 8/1962 | France | 417/440 |
| 23,823 | 12/1970 | Japan | 417/310 |
| 420,501 | 12/1934 | United Kingdom | 417/440 |
| 704,110 | 2/1954 | United Kingdom | 418/82 |

*Primary Examiner*—John J. Vrablik
*Attorney, Agent, or Firm*—Dowell & Dowell

[57] ABSTRACT

A rotary compressor apparatus having a housing with a rotor eccentrically mounted therein and such rotor includes a plurality of sliding vanes which define constantly changing compression pockets as the rotor is rotated. The apparatus includes a plurality of ports which may be opened to permit full unloading when starting the compressor and which may be selectively closed to control the quantity of gaseous matter being compressed. The apparatus also includes a high pressure oil injector at each end of the rotor for sealing such ends to prevent loss of compression.

2 Claims, 6 Drawing Figures

FIG. 4
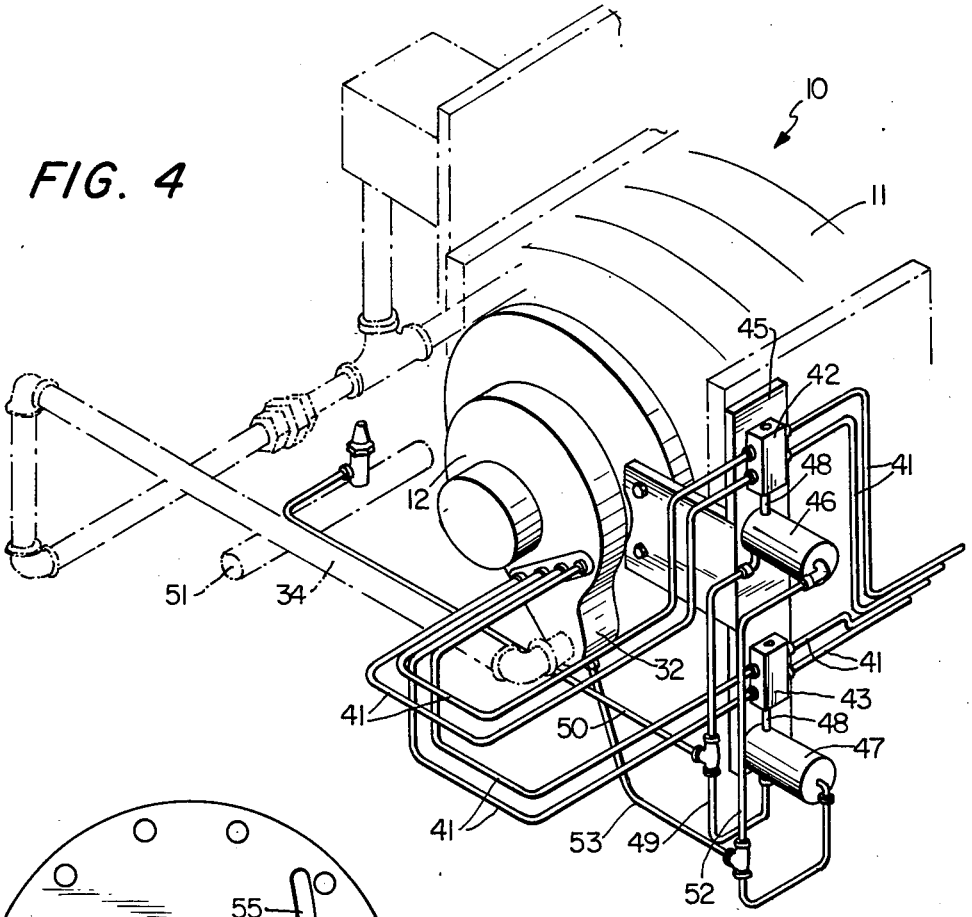
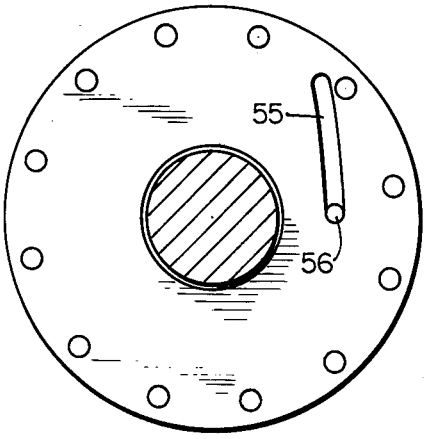
FIG.6
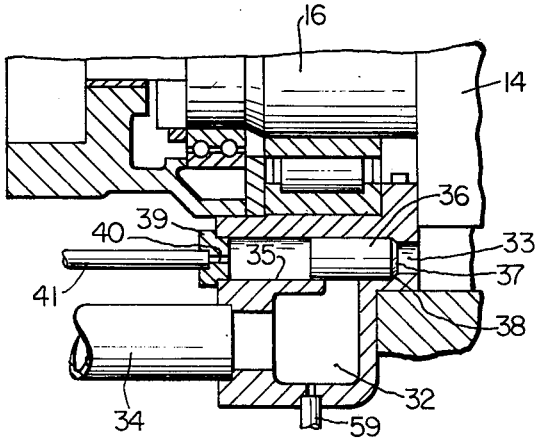
FIG. 5

BLADE-TYPE ROTARY COMPRESSOR WITH FULL UNLOADING AND OIL SEALED INTERFACES

BACKGROUND OF THE INVENTION

1. Field of the Invention

This invention relates generally to the compression of gaseous matter and relates particularly to a rotary compressor having a rotor with a plurality of sliding blades mounted within a housing, as well as means for increasing the efficiency of such compressor.

2. Description of the Prior Art

Heretofore many efforts have been made to provide blade-type rotary compressors which include a housing having an elongated generally cylindrical bore with a rotor eccentrically mounted therein. Such rotor usually has a plurality of blades or sliding vanes disposed within grooves or recesses generally radially of the rotor so that when the rotor is rotated the blades slide in and out of the grooves to define a plurality of compression pockets whose volume constantly changes as the rotor rotates. The housing normally is provided with a suction opening on one side through which gaseous matter is introduced into the bore of the housing so that the gaseous matter enters the compression pockets as the pockets are enlarging until the pockets reach maximum capacity. Thereafter, the introduction of gaseous matter is interrupted and the trapped gaseous matter is compressed and discharged through a pressure discharge opening in the housing.

In order to permit the blades or sliding vanes to rotate against the fixed housing, a film of oil is injected into the housing along the length of the bore for cooling and lubricating purposes. However, sealing the ends of the rotor and the blades or sliding vanes has presented particular problems since the ends of the rotor and blades are not only rotating relative to the fixed end caps of the housing, but the blades are simultaneously moving in and out radially of the rotor. Additionally problems have been encountered when the compressor was being started since non-compressible cooling and lubricating oil has had an opportunity to collect within the compression pockets and a substantial amount of work has been required to compress the gaseous matter trapped in the compression pockets.

Accordingly a drive motor which was substantially larger than required during running has been required in order to start the rotor and get the rotor to operating speeds. After the rotor is rotating at operating speed, such rotor functions as a fly wheel so that substantially less power is required to keep the rotor operating. Also the trapped non-compressible oil, as well as the gaseous matter within the compression pockets have caused damage to the compressor and particularly the blades or sliding vanes during the starting operation of the compressor.

Some efforts have been made to provide a capacity control for rotary compressors, such as the Tosh U.S. Pat. No. 3,451,614; however, these prior art devices normally have been located in one end only of the compressor and have provided a partial bypass only and have not provided full unloading for starting the compressor. Additionally some efforts have been made to inject oil under pressure into the area adjacent to the ends of the rotor to provide an oil sealed interface; however, the end seals have continued to present a major problem to rotary compressors. Laboratory tests indicated that leakage at the interface between the end of the rotor and the housing included 50 to 75% of total compressor capacity loss.

Some additional examples of the prior art include the U.S. Pat. Nos. to Pfeiffer 1,890,003; Dubrovin 2,337,849; Godbe 2,445,573; Menon 2,969,021; Hart 3,016,184; Keller 3,797,975 and British Pat. No. 704,110.

SUMMARY OF THE INVENTION

The present invention is embodied in a blade-type rotary compressor having a plurality of ports in each end cap which are spaced apart a distance substantially corresponding to the spacing of the blades or sliding vanes of the rotor, and which are selectively opened and closed so that each of the compression pockets can be fully unloaded during starting operations and additionally can function as a capacity control to regulate the amount of gaseous matter which is being compressed during the operation of the device. Additionally the rotary compressor of the present invention includes means for injecting oil under pressure in a particular manner at the interface between the ends of the rotor and the adjacent housing to form an oil seal between the rotating and fixed members while minimizing the quantity of non-compressible oil which is introduced into the blade-receiving grooves of the rotor.

It is an object of the invention to provide a plurality of selectively operated unloading ports at each end of the rotor of a rotary compressor so that each of the compression pockets can be fully unloaded when the compressor is started and can be selectively operated to control the amount of gaseous matter being compressed during the operation of the compressor.

It is another object of the invention to provide an oil seal at the interface between each end of the rotor and the housing which reduces compression loss without introducing oil into the blade-receiving grooves of the rotor.

BRIEF DESCRIPTION OF THE DRAWINGS

FIG. 4 is a fragmentary perspective of one end of the compressor.

FIG. 5 is an enlarged fragmentary section of one of the unloading ports and the control mechanism therefor.

FIG. 6 is a section taken on the line 6—6 of FIG. 2.

DESCRIPTION OF THE PREFERRED EMBODIMENT

Figure 3:
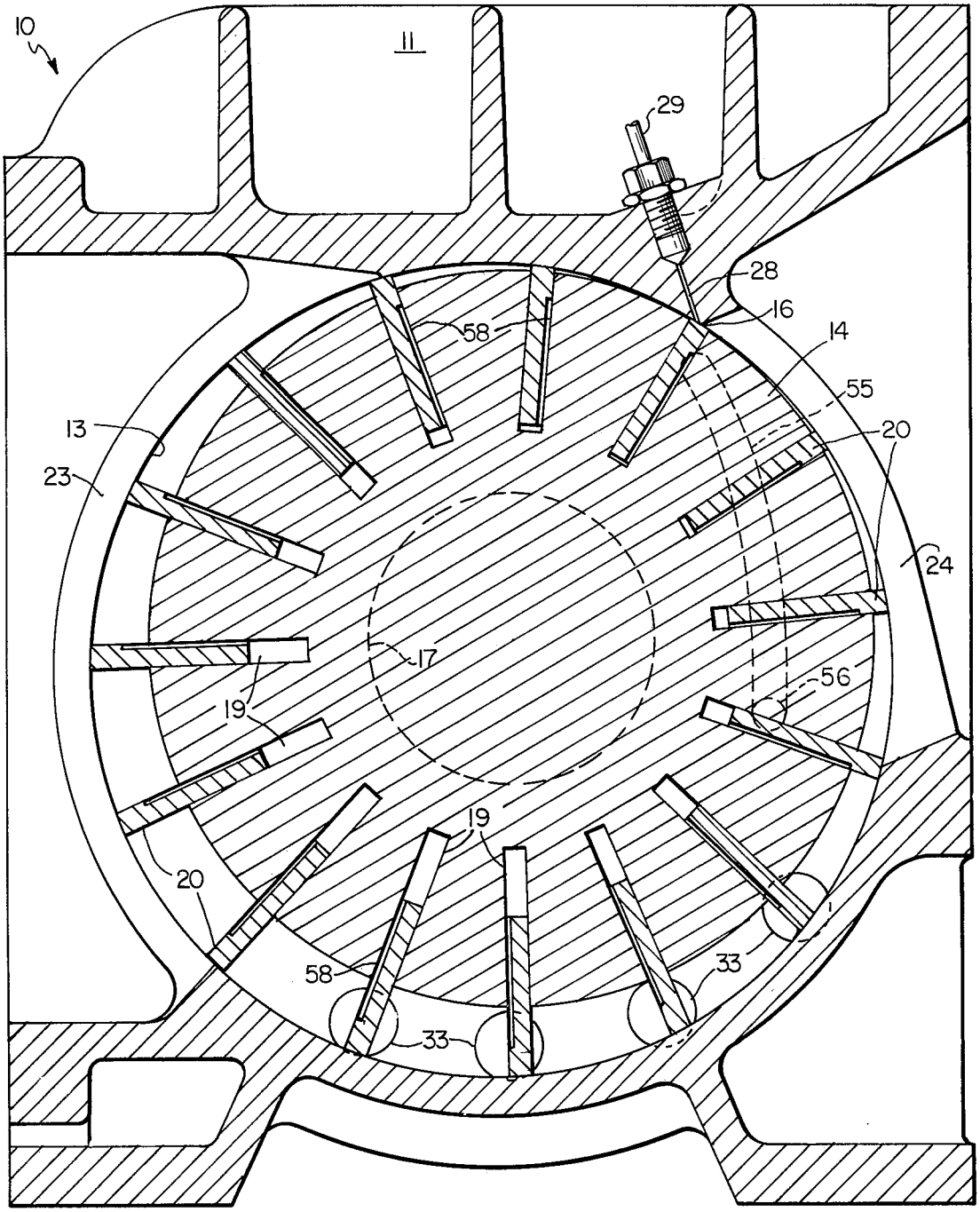
FIG. 3 is a section taken on the line 3—3 of FIG. 2.

With continued reference to the drawings, a blade-type rotary compressor 10 includes an elongated housing or body 11 having an end cap 12 at each end. The body 11 has a generally cylindrical bore 13 extending the full length thereof. A rotor 14, which has a diameter less than the diameter of the bore 13 of the body, is eccentrically mounted within such bore in such a manner that the outer peripheral surface of the rotor substantially engages the inner peripheral surface of the bore 13 along a seal line 15 (FIG. 3). The opposite ends of the rotor 14 are provided with shafts 16 and 17, respectively which are supported by bearings within the end caps 12. The shaft 16 extends outwardly from the end cap where it is drivingly connected to a power plant (not shown) for driving the rotor. If desired the outer end of the shaft 17 may be connected to drive a pump 18.

Figure 1:
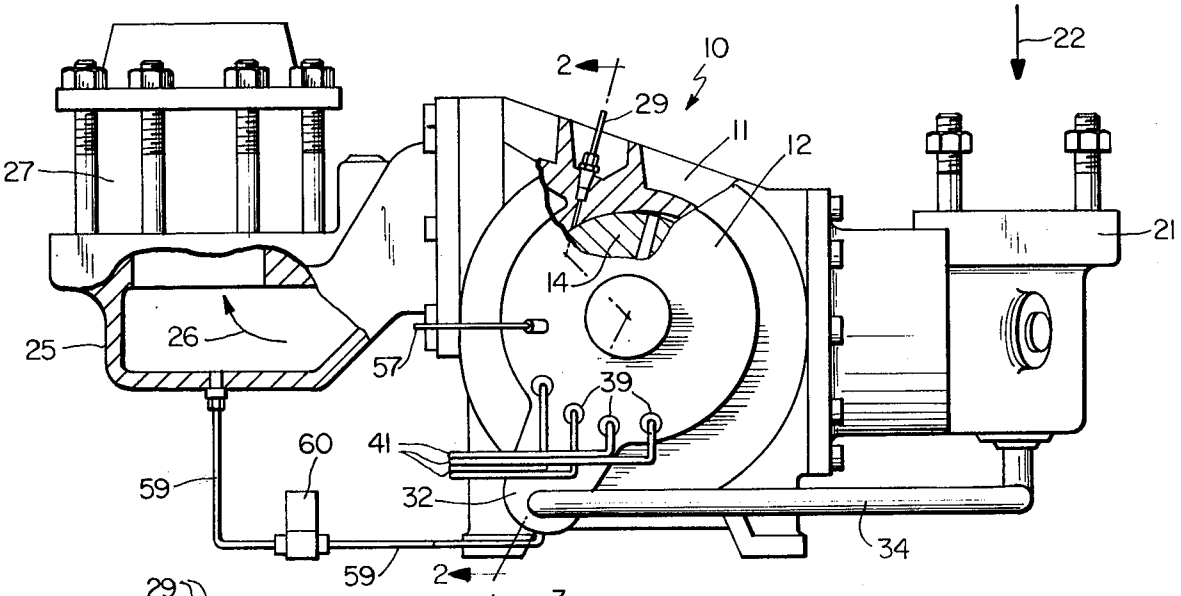
FIG. 1 is a side elevation of the rotary compressor of the present invention.

The rotor 14 has a plurality of radially disposed grooves or recesses 19 extending the full length of the same and each of such grooves slidably receives a blade or vane 20 in such a manner that when the rotor is rotated the outer side edge surfaces of the blades remain in sliding engagement with the peripheral surface of the bore 13 of the body 11. The areas between adjacent blades 20 and between the rotor 14 and the bore 13 define a plurality of compression pockets which receive gaseous matter such as air, vapor or a vaporized refrigerant or the like, to be compressed. In order to introduce gaseous matter into the compressor 10, a suction chamber 21 is mounted on one side of the body 11 and such chamber receives gaseous matter from any desired source (not shown) which flows in the direction of the arrow 22 (FIG. 1).

With particular reference to FIG. 3, the body 11 has an inlet opening 23 providing communication between the suction chamber 21 and the interior of the bore 13 and such inlet opening extends from a point where the compression pockets begin to open, after such pockets have passed the seal line 15, to a point where the compression pockets are substantially at maximum capacity. Preferably, although not shown in the drawings, the inlet opening 23 includes a plurality of elongated slots disposed at an angle to a vertical plane which permit free flow of the gaseous matter therethrough, while the land areas between the slots provide bearing surfaces for the side edge surfaces of the blades 20.

On the opposite side of the body from the suction chamber 21, an outlet or discharge opening 24 is provided which discharges compressed gaseous matter into a pressure chamber 25 so that the gaseous matter which has been compressed within the compression pockets is discharged in the direction of the arrow 26. A non-return valve 27 of conventional construction communicates with the pressure chamber 25 to prevent back pressure on the rotary compressor 10 particularly during starting operations. The discharge opening 24 may include a plurality of elongated slots similar to the slots of the inlet opening.

In order to provide a lubricating and cooling film of oil, as well as to provide an oil seal between the side edge surfaces of the blades 20 and the bore 13, a plurality of oil inlet ports 28 (FIGS. 1 & 2) extend through the body 11 and terminate adjacent to the seal line 15. Each of such ports is connected to a supply line 29 and such lines are connected to a supply of oil under pressure (not shown) which may be pressurized in any desired manner, such as by the pump 18.

Each of the caps 12 is provided with an exhaust manifold 32 that communicates with a plurality of fluid outlet ports 33 which are open to the bore 13 of the body 11. As illustrated best in FIG. 3, such fluid outlet ports are spaced apart a distance substantially corresponding to the spacing between the blades or vanes 20 on the compression side of the body. The first fluid outlet port nearest the inlet opening 23 is spaced from such inlet opening a distance less than the length of a compression pocket and the fluid outlet port nearest the discharge opening 24 is spaced therefrom a distance less than the distance of a compression pocket.

With this arrangement of fluid outlet ports, when all of the ports are open, any gaseous matter trapped in the compression pockets is exhausted through the outlet ports 33 to the manifold 32 and from the manifold such gaseous matter is returned to the suction chamber 21 through a return line 34. As long as the ports 33 are open, all of the compression pockets are unloaded so that no work is required for compressing the gaseous matter, particularly during the starting operation of the rotary compressor 10. Normally the outlet ports 33 are open when the compressor is not in operation to permit excess non-compressible lubricating oil to be discharged so that such oil does not accumulate within the compression pockets.

In order to selectively close the outlet ports 33 so that the gaseous matter trapped within the compression pockets can be compressed, each port 33 communicates with a bore 35 which extends inwardly from the outer surface of each of the end caps. Such bores have a larger diameter than the diameter of the outlet ports 33 and are arranged concentrically therewith. A piston 36 is slidably mounted within each of the bores 35 and each piston has a tapered inner end 37 which functions as a valve when engaging a shoulder or valve seat 38 that connects the outlet ports 33 to the bores 35. The outer end of each bore 35 is closed by a plug 39 having an orifice 40 extending therethrough which communicates with one end of a high pressure oil line 41.

With particular reference to FIG. 4, the opposite end of each high pressure oil line 41 is connected to an oil distributor 42 or 43 carried by a mounting bracket 45 which is fixed to one of the end caps 12. Each of the oil distributors is arranged in a manner to selectively supply oil under pressure to two of the high pressure oil lines 41 at each end of the compressor 10. In order to selectively operate the pistons 36 to control the opening and closing of the fluid outlet ports 33, a pair of solenoid operated three-way valves 46 and 47 are mounted on the bracket 45 for regulating the flow of fluid under pressure into the oil distributors 42 and 43, respectively.

Each solenoid operated valve is connected to its associated oil distributor by a pipe 48 and such solenoid operated valves are connected by a branch line 49 to a feed line 50. The feed line 50 is connected to a high pressure supply pipe 51 for selectively supplying oil under a predetermined high pressure to the valves 46 and 47. To relieve the pressure from the oil distributors 42 and 43 and the pistons 36, particularly during shutdown and starting of the compressor, each of the solenoid operated valves is connected by a branch line 52 to a relief line 53 which communicates with the exhaust manifold 32 so that the high pressure oil is relieved to the suction side of the compressor. Since this condition rarely occurs when the compressor is operating, the amount of oil which is discharged to the suction side of the compressor is minimal.

In the embodiment shown in FIG. 4, each of the oil distributors 42 and 43 controls two pairs of high pressure lines which communicate with opposed pairs of bores 35 so that when one of the solenoid operated valves is operated, two of the pistons at each end of the compressor are closed. It is contemplated that if desired an oil distributor and a solenoid operated valve could be provided to operate single opposed pistons at opposite ends of the compressor.

In addition to simultaneously applying a predetermined pressure to each of the pistons 36 during operation of the compressor and relieving the pressure on such pistons for unloading purposes, the solenoid operated valves may be operated independently so that they function as a capacity control during the operation of the compressor. In this case such solenoid operated valves are opened sequentially either automatically or manually with the pistons nearest the inlet opening 23 being open first. The predetermined pressure which is applied to the rear of the pistons 36 is greater than the pressure normally created in the compression pockets when the compressor is operating. However, if the pressure within the compression pockets increases to a level higher than the pressure on the pistons, such pistons are unseated and the pressure within the pocket is vented before damage to the structure occurs.

With particular reference to FIGS. 1, 3 and 6, it is important that an oil seal be provided between the ends of the rotor 14, which is being rotated, and the end caps 12 which are fixed. It is particularly important to provide the oil seal at the discharge side of the compressor 10 since it is only at the discharge side that the pressure buildup in the compression pockets is sufficient to force gaseous material past the ends of the blades into the trailing pockets where the pressure is lower. Additionally it is important that an excessive amount of the non-compressible sealing oil does not enter the open ends of the grooves 19 in which the blades are sliding and prevent the proper operation of such blades.

It has been determined by experimentation that an arcuate groove or channel 55, which is located in each of the end caps 12 in the area of the discharge opening 24, provides the most efficient sealing and lubrication at the interface between the rotor 14 and the end caps. As illustrated best in FIGS. 3 and 6, the channel 55 communicates with an inlet port 56 connected to a supply line 57 the opposite end of which is connected to a source of lubricating oil under pressure (not shown). The inlet port 56 normally is not at a right angle to the interface but instead is disposed at an angle which is determined experimentally to provide for maximum oil seal in the interface area along the entire length of the groove 55.

The inlet end of the channel 55 is located outwardly of the inner side edge surfaces of the blades 20 so that such channel is not directly exposed to the grooves 19 in which the blades are mounted. Preferably the inlet end of the channel 55 is located substantially at the point where the compression pockets are opened to the discharge opening 24 of the body and such channel curves upwardly and outwardly so that it terminates adjacent to the periphery of the rotor 14 in the area of the seal line 15.

The oil which is introduced through the inlet port into the channel 55 is at a higher pressure than the pressure within the compression pockets so that such oil flows into the interface between the rotor and the end caps to provide an oil seal at such interface. Since the rotor 14 is rotating at a substantial speed, the oil discharged from the channel 55 into the interface tends to move outwardly from the axis of rotation of the rotor through centrifugal action and this action urges the non-compressible sealing oil away from the inner ends of the grooves 19 even though the blades 20 are moving inwardly at the time.

A small amount of non-compressible oil moves inwardly toward the axis of rotation of the rotor, depending upon the pressure of the oil supplied to the channel 55 and therefore some small amount of non-compressible oil may enter the grooves 19. In order to prevent any excess accumulation of oil within the grooves 19, each of the blades 20 is provided with a plurality of angularly disposed relief grooves 58 along the trailing surface. Each of such relief grooves extends from the inner edge surface of the blade 20 to a point spaced from the outer edge surface thereof. With this arrangement any non-compressible oil trapped in the grooves 19 of the rotor is discharged into the compression pockets when the blades are extended. The relief grooves 58 likewise permit air or other fluid which is being compressed to enter the inner ends of the grooves 19 and relieve any suction effect at the base of the blades when the blades move outwardly.

Figure 2:
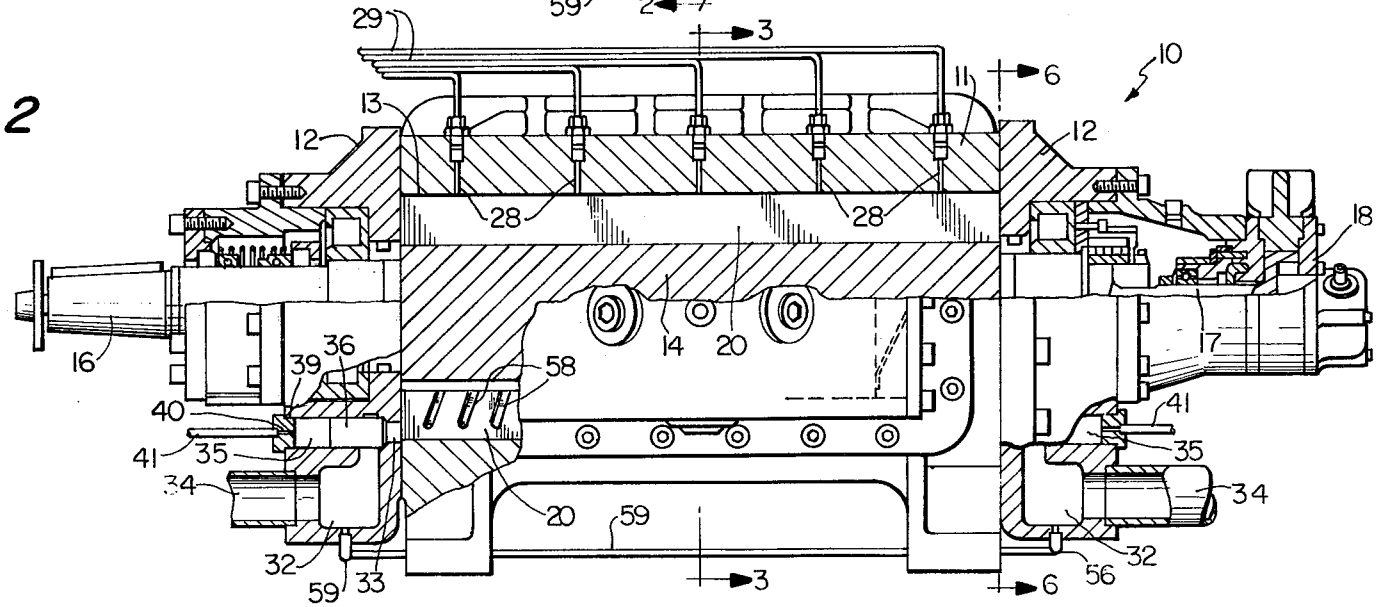
FIG. 2 is a partial section taken on the line 2—2 of FIG. 1.

With particular reference to FIGS. 1 and 2, the non-return valve 27 carried by the pressure chamber 25 is located in a position such that a small amount of fluid under pressure may be trapped in the pressure chamber on shutdown of the compressor 10. It is desirable to relieve this trapped pressurized fluid before the compressor is started, so as to fully unload the compressor for starting purposes. A relief line 59 has one end connected to the pressure chamber 25 and the opposite end is connected to each of the exhaust manifolds 32. A solenoid operated valve 60 is disposed in the line 59 so that when the compressor is shut down, the valve 60 opens to permit any fluid under pressure within the pressure chamber to be discharged to the exhaust manifolds 32 and then through the return lines 34 to the suction chamber 21. After the compressor 10 has been started and has reached an operating speed, the solenoid operated valve 60 is closed so that fluid can be compressed and discharged through the pressure chamber 25 and the non-return valve 27.

In the operation of the device, the rotor 14 is rotated in a counterclockwise direction, as illustrated in FIG. 3, so that during the first portion of rotation, the blades 20, which are fully retracted at the seal line 15, move outwardly of the grooves 19 to provide a plurality of compression pockets which continually enlarge until the blades are substantially diametrically opposite such seal line. During this first part of the rotation, the compression pockets are exposed to the inlet opening 23 so that fluid to be compressed flows from the suction chamber 21 into the pockets until the pockets reach maximum capacity. At this time introduction of fluid into the pockets is interrupted and continued rotation of the rotor during a second portion of rotation causes the fluid within the pockets to be compressed until the pockets reach the discharge opening 24. As soon as the compression pockets communicate with the discharge opening, the pressurized fluid within the pockets begins to be discharged into the pressure chamber 25 and passes through the non-return valve 27 into a fluid pressure system. Continued rotation of the rotor through a third portion of rotation pumps all of the compressed fluid through the discharge opening until the blades pass the seal line 15.

During the time that the compressor is operating at operating speed and at maximum capacity, the solenoid operated valves 46 and 47 are open so that oil under a pressure higher than the pressure created in the compression pockets passes through such valves into the oil distributors 42 and 43 and then through the high pressure tubings 41 into each of the bores 35 to force the pistons 36 inwardly so that the tapered end 37 engages the valve seat 38 and prevents discharge of fluid under pressure from the compression pockets. When the compressor is not operating at maximum capacity, one or more of the solenoid operated valves 46 and 47 may be closed to relieve the pressure behind the associated piston 36 so that pressure created within the compression pockets causes such piston to move outwardly and unseat the valve so that fluid from the compression pockets passes through the fluid outlet port 33 into the exhaust manifold 32 to regulate the quantity of the fluid being compressed. If the pressure created within the compression pockets should exceed the pressure within the bores 35, the pistons 36 are moved rearwardly so that the pressure within the compression pockets is relieved before damage to the compressor occurs.

When the compressor has been shut down, it is desirable to begin operation of the compressor under no-load conditions so that substantially no work is done by the compressor until the rotor 14 reaches operating speed. To provide the no-load condition, the solenoid operated valves 46 and 47 normally are closed when the compressor is shut down to relieve the pressure in the bores 35 so that pressure within the compression pockets moves the pistons 36 rearwardly and opens the fluid outlet ports so that fluid trapped within the compression pockets can be exhausted to the suction chamber 21. After the rotor 14 has stopped rotating, the fluid outlet ports 33 remain open so that any cooling and lubricating oil within the compressor which flows by gravity to the lower portion of the bore 13 is drained through the fluid outlet ports. Since the fluid outlet ports are spaced apart a distance no greater than the distance between the blades 20, there is little chance of any accumulation of excess oil within the pockets while the rotor is idle. When the rotor is started, any gaseous matter trapped in the compression pockets by the rotation of the rotor is discharged through the outlet ports so that substantially no work is done by the compressor until the solenoid operated valves 46 and 47 are opened to cause the pistons 36 to move inwardly and close the outlet ports 33.

During the time that the compressor is operating it is important to provide an oil seal at the interface between the rotor and the end caps. In order to do this oil under a pressure higher than the pressure created within the compression pockets is introduced through the supply line 57 and the inlet port 56 into the arcuate channel 55 which is located in the area of highest compression of the pockets so that the compressed gaseous material within the pockets cannot bypass the ends of the sliding blades and compression loss is reduced to a minimum.

I claim:

1. In a rotary compressor having a body with a cylindrical bore, end caps at opposite ends of said body, a rotor eccentrically mounted within said bore, said rotor substantially engaging said bore along a seal line, means for driving said rotor, said rotor having a plurality of radial grooves extending the entire length, a blade slidably mounted in each groove, said blades cooperating with said bore, said end caps and said rotor to define a plurality of compression pockets, said body having a fluid inlet opening on one side for introducing fluid to be compressed into said compression pockets and a discharge opening remote from said inlet opening for discharging compressed fluid from said body, means for driving said rotor in a direction from said inlet opening toward said discharge opening, the area between said inlet and discharge openings in the direction of rotation of said rotor defining the compression side of said compressor, the improvement comprising, each of said end caps having an elongated arcuate channel extending throughout its length adjacent to the discharge opening of said body, and means for introducing oil under pressure greater than the pressure created within the compression pockets into an inlet end of said channel, said inlet end of said channel being located at the beginning of the discharge opening outwardly of the inner side edge surfaces of the blades and spaced inwardly from the periphery of said rotor, said channel curving outwardly along the discharge opening and terminating adjacent to the periphery of said rotor substantially at said seal line adjacent the end of the discharge opening.

2. The structure of claim 1 including a plurality of fluid passageways each having a separate outlet opening in each of said end caps, the outlet openings being arcuately disposed between said fluid inlet opening and said discharge opening and communicating with said compression pockets between said rotor and the wall of said bore, said outlet openings being in spaced relationship to each other and to said fluid inlet and said fluid discharge openings so that the angular distance between the adjacent fluid openings along the compression side of the compressor is less than the angular distance between adjacent rotor blades in order that each compression pocket between said inlet and discharge openings communicates with at least one outlet opening at all times, each of said passageways leading to said fluid inlet, and means for selectively closing each of said outlet openings, whereby all of said outlet openings may be selectively opened to provide full unloading of said compressor through said passageways on starting.

* * * * *